US006306572B1

(12) United States Patent
Uyttendaele et al.

(10) Patent No.: US 6,306,572 B1
(45) **Date of Patent: *Oct. 23, 2001**

(54) BINDERS FOR THERMOGRAPHIC MATERIALS

(75) Inventors: Carlo Uyttendaele, Mortsel; Huub Van Aert, Belgium; Frank Louwet, Diepenbeek; Ivan Hoogmartens, Wilrijk, all of (BE)

(73) Assignee: Agfa-Gevaert (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,637

(22) Filed: Aug. 17, 1998

Related U.S. Application Data

(60) Provisional application No. 60/069,587, filed on Dec. 11, 1997.

(30) Foreign Application Priority Data

Sep. 17, 1997 (EP) ..... 97202875

(51) Int. Cl.[7] ..... G03C 1/498

(52) U.S. Cl. ..... 430/617; 430/529; 430/531; 430/620; 503/214; 427/150

(58) Field of Search ..... 430/617, 619, 430/531, 536, 620, 503, 430; 427/150, 148

(56) References Cited

U.S. PATENT DOCUMENTS

| | | | | |
|---|---|---|---|---|
| 4,123,274 | | 10/1978 | Knight et al. | 96/66 |
| 4,504,575 | | 3/1985 | Lee | 430/531 |
| 4,529,689 | | 7/1985 | Lee | 430/534 |
| 4,828,971 | | 5/1989 | Przezdziecki . | |
| 4,960,681 | * | 10/1990 | Aotsuka | 430/351 |
| 5,876,915 | * | 3/1999 | Deroover et al. | 430/619 |

FOREIGN PATENT DOCUMENTS

| | | |
|---|---|---|
| 3635441 | 10/1986 | (DE) . |
| 0678776 | 10/1995 | (EP) . |

OTHER PUBLICATIONS

Research Disclosure #19551, Jul. 1980.*

Database WPI; Section Ch. Week 8641; Derwent Publications Ltd., London, Great Britain; Class A14, AN 86–267419; XP002069548 and JP 61 193 142 A (Konishiroku Photo Ind. Co., Ltd.) *abstract*.

* cited by examiner

*Primary Examiner*—Thorl Chea
(74) *Attorney, Agent, or Firm*—Leydig, Voit & Mayer, Ltd.

(57) ABSTRACT

A substantially light-insensitive black and white thermographic material including a support and a thermosensitive element, containing a substantially light-insensitive organic silver salt, a reducing agent therefor in thermal working relationship therewith and a binder, wherein the binder is a water-dispersible film-forming polymer with covalently bonded moieties with one or more acid groups or anhydrides thereof and the thermographic material is thermally developable under substantially water-free conditions; and a process for producing the substantially light-insensitive black and white thermographic material comprising the steps of: producing an aqueous dispersion of the substantially light-insensitive organic silver salt; producing one or more aqueous coating compositions containing together the aqueous dispersion of the substantially light-insensitive organic silver salt, the reducing agent and the binder; and applying the one or more aqueous coating compositions to the support thereby forming after drying the thermosensitive element.

10 Claims, No Drawings

BINDERS FOR THERMOGRAPHIC MATERIALS

The application claims benefit of U.S. Provisional Application 60/069,587 filed Dec. 11, 1997.

DESCRIPTION

1. Field of the Invention

The present invention relates to a substantially light-insensitive black and white thermographic material comprising a thermosensitive element containing a water-dispersible film-forming polymer having covalently bonded moieties with one or more acid groups.

2. Background of the Invention

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes colour or optical density.
2. Image-wise transfer of an ingredient necessary for the chemical or physical process bringing about changes in colour or optical density to a receptor element.
3. Thermal dye transfer printing wherein a visible image pattern is formed by transfer of a coloured species from an image-wise heated donor element onto a receptor element.

Most of the "direct" thermographic recording materials are of the chemical type. On heating to a certain conversion temperature, an irreversible chemical reaction takes place and a coloured image is produced. A wide variety of chemical systems has been suggested some examples of which have been given on page 138 of Kurt I. Jacobson-Ralph E. Jacobson, The Focal Press—London and New York (1976), describing the production of a silver metal image by means of a thermally induced oxidation-reduction reaction of a silver soap with a reducing agent.

DE 3635441 discloses a process for producing an image, characterized in that a thermally developable photosensitive material, comprising a support with at least a photosensitive silver halide and a high molecular weight compound containing a repeating unit derived from a vinyl monomer with a —COOM—group and/or a —$SO_3$M-group, wherein M represents a hydrogen atom or an alkali metal atom, is heated, simultaneously or after image-wise exposure, in the presence of water and at least a base and/or a base-precursor.

JP 61-193142 discloses a heat development photosensitive material characterized in that in thermally developed photosensitive material which has a photosensitive layer containing at least silver halide particles on a support, the said photosensitive material has a layer which contains a water soluble or water dispersible block copolymer which has a polyvinyl alcohol system polymer as one component and a polymer which has an ionic group as the other component.

EP 678 776 discloses a thermally processable imaging element, said element comprising: (1) a support; and (2) a thermographic or photothermographic imaging layer on one side of said support; characterized in that said element additionally comprises (3) at least one electroconductive outermost layer comprised of electrically-conductive metal-containing particles dispersed in a polymeric binder in an amount sufficient to provide a surface resistivity of less than $5\times10^{11}$ ohms/square. However, there is no teaching in this document as regards thermographic materials based on organic silver salts and reducing agents.

Wo 94/16361 discloses a multilayer heat-sensitive material which comprises: a colour-forming layer comprising: a colour-forming amount of finely divided, solid colourless noble metal or iron salt of an organic acid distributed in a carrier composition; a colour developing amount of a cyclic or aromatic organic reducing agent, which at thermal copy and printing temperatures is capable of a colour-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the colour-forming layer. In the description of WO 94/16361 are recited the following water-soluble polymeric carriers: polyvinyl alcohol, methyl cellulose, carboxymethyl cellulose, polysaccharide gums, gelatins, styrene butadiene copolymers, hydroxylated corn starch, acrylic latexes and blends and mixtures thereof. As a water-soluble dispersing agent the ammonium salt of styrene/acrylic acid is recited, with Lupasol™ FF-3249 from BASF being used in the invention examples.

Coating of thermographic materials from aqueous media is preferred over coating from solvent for ecological and economic reasons. However, the inventors of the present invention found that black and white thermographic materials containing conventional acrylic latexes coated from aqueous media, as disclosed in WO 94/16361 an unacceptable brownish image tone.

OBJECTS OF THE INVENTION

It is therefore an object of the present invention to provide thermographic materials coated from aqueous media which exhibit improved image tone, while maintaining high maximum density and low minimum density levels upon printing.

Further objects and advantages of the invention will become apparent from the description hereinafter.

SUMMARY OF THE INVENTION

It has been surprisingly found that black and white prints made with thermographic materials coated from an aqueous medium exhibit substantially improved image tone and/or archivability and/or light stability upon using water-dispersible film-forming polymers with covalently bonded moieties with one or more acid groups instead of the conventional acrylic latexes disclosed for thermographic materials coated from aqueous media in WO 94/16361.

The above-mentioned objects are realized by a substantially light-insensitive black and white thermographic material including a support and a thermosensitive element, containing a substantially light-insensitive organic silver salt, a reducing agent therefor in thermal working relationship therewith and a binder, wherein the binder is a water-dispersible film-forming polymer with covalently bonded moieties with one or more acid groups or anhydrides thereof and the thermographic material is thermally developable under substantially water-free conditions.

A process for producing the substantially light-insensitive black and white thermographic material referred to above comprising the steps of: producing an aqueous dispersion of the substantially light-insensitive organic silver salt; producing one or more aqueous coating compositions containing together the aqueous dispersion of the substantially light-insensitive organic silver salt, the reducing agent and the binder; and applying the one or more aqueous coating compositions to the support thereby forming after drying the thermosensitive element.

Preferred embodiments of the present invention are disclosed in the detailed description of the invention.

DETAILED DESCRIPTION OF THE INVENTION

Substantially

By substantially light-insensitive is meant not intentionally light sensitive.

By thermally developable under substantially water-free conditions as used herein, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process", Fourth Edition, Macmillan 1977, page 374.

Aqueous

The term aqueous for the purposes of the present invention includes mixtures of water with water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc.

Polymers with Covalently Bonded Moieties with one or more Acid Groups or Anhydrides Thereof Preferred polymers having covalently bonded moieties with one or more acid groups or anhydrides thereof for use in the present invention have covalently bonded moieties with carboxylic acid groups or anhydrides thereof, for example copolymers of acrylic acid, methacrylic acid, crotonic acid, itaconic acid, mesaconic acid, glutaconic acid, citraconic acid, aconitic acid, maleic acid, maleic anhydride, fumaric acid, 3,4-dicarboxy-styrene and N-(1,2-dicarboxyethyl)-methacylamide. Particularly preferred polymers with covalently bonded moieties with one or more carboxylic acid groups or anhydrides thereof are copolymers having monomer units selected from the group consisting of itaconic acid, mesaconic acid, glutaconic acid, citraconic acid, aconitic acid and maleic anhydride.

Preferred polymers having covalently bonded moieties with one or more acid groups or anhydrides thereof for use in the present invention have crosslinkable groups, for example: aceto-acetoxy-groups, epoxy-groups and double bonds. Further preferred polymers having covalently bonded moieties with one or more acid groups or anhydrides thereof for use in the present invention further contain covalently bonded ionic groups. Still further preferred polymers having covalently bonded moieties with one or more acid groups or anhydrides thereof for use in the present invention have acid groups with a pKa greater than 3.

Further preferred polymers having covalently bonded moieties with one or more acid groups or anhydrides thereof are copolymers having monomer units selected from the group consisting of acrylates, methacrylates, styrene, diene monomers, vinyl esters, substituted vinyl esters, polycarboxylic acids, polyols and polyisocyanates.

Polymers having covalently bonded moieties with one or more acid groups or anhydrides thereof used according to the present invention which are polymer latexes are also preferred.

Suitable water-dispersible film-forming polymers for use in the present invention are summarized in the table below:

| polymer latex number | B [% by wt.] | IP [% by wt.] | BA [% by wt.] | S [% by wt.] | MMA [% by wt.] | IA [% by wt.] | MAA [% by wt.] | AA [% by wt.] |
|---|---|---|---|---|---|---|---|---|
| 1 | 47.5 | — | — | — | 47.5 | 5 | — | — |
| 2 | 49 | — | — | — | 49 | 2 | — | — |
| 3 | — | 47.5 | — | — | 47.5 | 5 | — | — |
| 4 | — | — | 43 | 55 | — | 2 | — | — |
| 5 | — | — | 43 | 55 | — | — | 2 | — |
| 6 | — | — | 47 | 46 | — | — | 7 | — |
| 7 | — | — | 44 | 54 | — | — | 2 | — |
| 8 | — | — | 47.5 | 47.5 | — | — | — | 5 |

where:
B = butadiene;
IP = isoprene;
BA = butyl acrylate;
EA = ethyl acrylate;
S = styrene;
MMA = methyl methacylate;
IA = itaconic acid;
MAA = methacrylic acid;
and AA = acrylic acid.

Auxiliary Binders

The water-dispersible film forming polymer with covalently bonded moieties with one or more acid groups or anhydrides thereof used according to the present invention may be used with additional water-soluble and/or water-dispersible binders. Film-forming binders suitable for materials coated from solvent dispersions or solutions may be all kinds of natural, modified natural or synthetic resins or mixtures of such resins.

Suitable water-soluble film-forming binders for use in thermographic materials according to the present invention are: polyvinyl alcohol, polyacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives.

Suitable water-dispersible binders for use in the thermographic materials of the present invention may be any water-insoluble polymer e.g. water-insoluble cellulose derivatives, polyurethanes, polyesters and polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides, methacrylates, acrylates, methacrylic acids, acrylic acids, vinyl esters, styrenes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion.

Preferred auxiliary binders for use together with the polymer having covalently bonded moieties with one or more acid groups in the thermosensitive element of the present invention are gelatin and water-dispersible polymers having covalently bonded ionic groups.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but upon heating becomes a plasticizer for the recording layer and/or a liquid solvent for at least one of the redox-reactants.

Thermosensitive Element

According to the present invention, a substantially light-insensitive black and white thermographic recording material is provided comprising a thermosensitive element including a substantially light-insensitive organic silver salt, an organic reducing agent therefor in thermal working relationship therewith and a binder. The element may comprise a layer system in which the ingredients are dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place. The thickness of the thermosensitive element is preferably in the range of 1 to 50 $\mu$m.

Organic Silver Salts

Preferred substantially light-insensitive organic silver salts used in the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the present invention. A process for producing a suspension of particles containing a substantially light-insensitive organic silver salt is disclosed in EP-A 754 969.

The weight ratio of binder used according to the present invention to organic silver salt weight is preferably in the range of 0.2 to 6.

Organic Reducing Agents

Suitable organic reducing agents for the reduction of the substantially light-insensitive organic silver salt are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,417; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Auxiliary Reducing Agents

The above mentioned reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; or sulfonamidophenols as described in Research Disclosure 17842 published in February 1979, U.S. Pat. No. 4,360,581, U.S. Pat. No. 4,782,004 and in EP-A 423 891. The auxiliary reducing agents may be present in the imaging layer or in a polymeric binder layer in thermal working relationship thereto.

Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; 2-substituted malondialdehyde compounds as disclosed in U.S. Pat. No. 5,654,130; and organic reducing metal salts, e.g. stannous stearate described in U.S. Pat. Nos. 3,460,946 and 3,547,648.

Toning Agents

In order to obtain a neutral black image tone in the higher densities and neutral grey in the lower densities, thermographic recording materials according to the present invention may contain one or more toning agents. The toning agents should be in thermal working relationship with the substantially light-insensitive organic silver salt and reducing agents during thermal processing. Any known toning agent from thermography or photothermography may be used. Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Surfactants and Dispersants

Surfactants and dispersants aid the dispersion of ingredients which are insoluble in the particular dispersion medium. The thermographic recording materials of the present invention may contain one or more surfactants, which may be anionic, non-ionic or cationic surfactants and/or one or more dispersants.

Examples of suitable surfactants are:

| | |
|---|---|
| Surfactant Nr. 1 = | HOSTAPAL ™ B, a sodium trisalkylphenyl-polyethyleneglycol (EO 7–8) sulphate from Hoechst; |
| Surfactant Nr. 2 = | MERSOLAT ™ H80, a sodium hexadecylsulfonate from Bayer; |
| Surfactant Nr. 3 = | ULTRAVON ™ W, a sodium arylsulfonate from Ciba-Geigy; |
| Surfactant Nr. 4 = | TERGITOL ™ 4, a sodium 1-(2'-ethylbutyl)-4-ethylhexylsulphate; |
| Surfactant Nr. 5 = | MARLON ™ A-396, a sodium dodecylphenyl-sulfonate from Hüls; |
| Surfactant Nr. 6 = | HOSTAPAL ™ W, a nonylphenylpolyethylene-glycol from Hoechst. |

Suitable dispersants are natural polymeric substances, synthetic polymeric substances and finely divided powders, for example finely divided non-metallic inorganic powders such as silica.

Stabilizers and Antifoggants

In order to obtain improved shelf-life and reduced fogging, stabilizers and antifoggants may be incorporated into the thermographic materials of the present invention.

Other Ingredients

In addition to the ingredients the substantially light-insensitive black and white thermographic material may contain other additives such as free fatty acids, silicone oil, ultraviolet light absorbing compounds, white light reflecting and/or ultraviolet radiation reflecting pigments, silica, and/or optical brightening agents.

Support

The support for the substantially light-insensitive black and white thermographic material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition.

Protective Layer

A protective layer may also be provided for the thermosensitive element. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating.

The protective layer may comprise a dissolved lubricating material and/or particulate material, e.g. talc particles, optionally protruding therefrom. Examples of suitable lubricating materials are a surface active agent, a liquid lubricant, a solid lubricant or mixtures thereof, which may be used with or without a polymeric binder. Suitable slipping layer compositions are described, for example, in U.S. Pat. No. 5,587,350, U.S. Pat. No. 5,536,696, U.S. Pat. No. 5,547,914, WO 95/12495, EP-A 775 592 and EP-A 775 595.

Coating

The coating of any layer of the substantially light-insensitive black and white thermographic materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing, image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic material wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic material can also be carried out using an electrically resistive ribbon incorporated into the material. Image- or pattern-wise heating of the thermographic material may also proceed by means of pixelwise modulated ultra-sound, using e.g. an ultrasonic pixel printer as described e.g. in U.S. Pat. No. 4,908,631.

Industrial Application

Substantially light-insensitive black and white thermographic materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated.

i) subbing layer ingredients:

PAREZ RESIN™ 707: a 80% solids melamine-formaldehyde resin from AMERICAN CYANAMID;

HORDAMER™ PE02: a 40% aqueous dispersion of polyethylene from HOECHST;

ii) thermosensitive element ingredients:

| | | |
|---|---|---|
| K7598 | = | Type 7598, a calcium-free gelatin from AGFA-GEVAERT GELATINEFABRIEK vorm. KOEPFF & SÖHNE; |
| AgBeh | = | silver behenate |
| R01 | = | ethyl 3,4-dihydroxybenzoate |
| T01 | = | 7-(ethylcarbonato)benzo[e] [1,3]oxazine-2,4-dione |

and the following representative conventional acrylic latexes in COMPARATIVE EXAMPLES 1 to 5, according to the teaching of WO 94/16361:

| polymer latex number | B [% by wt.] | MMA [% by wt.] | BA [% by wt.] | S [% by wt.] |
|---|---|---|---|---|
| C01 | 50 | 50 | — | — |
| C02 | — | — | 44.5 | 55.5 |
| C03 | — | — | 15 | 85 |

where:
B = butadiene;
MMA = methyl methacrylate;
BA = butyl acrylate;
and S = styrene;

COMPARATIVE EXAMPLES 1 to 5 and INVENTION EXAMPLES 1 to 10

Preparation of Subbing Layer

A 0.34 mm thick polyethylene terephthalate sheet was coated to a thickness of 0.1 mm with a composition which after drying and longitudinal and transverse stretching produced a 175 μm thick support coated on with the following subbing-layer composition expressed as the coating weights of the ingredients present:

| | | |
|---|---|---|
| # | copolymer of terephthalic acid/isophthalic acid/sulfo-isophthalic acid/ethylene glycol (26.5/20/3.5/50): | 37.0 mg/m$^2$ |
| # | copolymer latex of ethyl acrylate/methacrylic acid (80/20): | 3.0 mg/m$^2$ |

-continued

| | | |
|---|---|---|
| # | HORDAMER ™ PE02: | 1.0 mg/m$^2$ |
| # | PAREZ RESIN ™ 707: | 7.0 mg/m$^2$ |

Preparation of a Silver Behenate Dispersion 9000 g of silver behenate were added with stirring to 9000 g of a 10% aqueous solution of Surfactant Nr 5 diluted with 20,146 g of deionized water and the mixture stirred for 30 minutes with a KOTTHOFF™ stirrer. The resulting dispersion was then passed four times through a MICROFLUIDICS™ microfluidizer at a pressure of 400 bar to obtain a finely divided aqueous silver behenate dispersion.

Preparation of a Tone Modifier Dispersion

The tone modifier dispersion was prepared by first dissolving 8.8 g of K7598 in 71.4 g of deionized water by first adding the gelatin, then allowing the gelatin to swell for 30 minutes and finally heating to 50° C. 20 g of T01 was added with ULTRA-TURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of T01 and 8.8% of gelatin.

Preparation of the Silver Behenate Emulsion Layers

The coating dispersions for the thermographic recording materials of COMPARATIVE EXAMPLES 1 to 5 and INVENTION EXAMPLES 1 to 10 were prepared by first dissolving 1.927 g of K7598 in deionized water at 38° C. (for the quantity of water see table 1), then adding with stirring to the warm K7598 solution: first 19.0 g of the silver behenate dispersion, then 5.68 g of the tone modifier dispersion as flakes followed by 15 minutes stirring, then the latex dispersion (for quantity, concentration and type see table 1), then 11.23 g of an aqueous ethanol solution containing 0.92 g of R01 and 0.62 g of boric acid and finally 1.310 g of a 3.7% by weight solution of formaldehyde to produce 60 g of a dispersion containing: 7.47% of silver behenate, 0.75% of Surfactant Nr 5, 4.04% of gelatin, 2.98% of polymer latex, 1.53% of R01, 1.03% of boric acid, 1.92% of T01 and 0.08% of formaldehyde.

TABLE 1

| | Quantity | polymer latex | | |
|---|---|---|---|---|
| | of water [g] | number | concentration [%] | weight [g] |
| Comparative Example number | | | | |
| 1 | 11.653 | C01 | 19.4 | 9.200 |
| 2 | 11.003 | C03 | 18.1 | 9.850 |
| 3 | 11.183 | C02 | 18.5 | 9.670 |
| 4 | 11.653 | C01 | 19.4 | 9.200 |
| 5 | 11.183 | C02 | 18.5 | 9.670 |
| Invention Example number | | | | |
| 1 | 14.713 | 1 | 29.1 | 6.140 |
| 2 | 14.903 | 1* | 30.0 | 5.950 |
| 3 | 14.903 | 1# | 30.0 | 5.950 |
| 4 | 14.713 | 1# | 29.1 | 6.140 |
| 5 | 10.723 | 4 | 17.6 | 10.130 |
| 6 | 10.973 | 4[a] | 18.1 | 9.880 |
| 7 | 11.083 | 5 | 18.3 | 9.770 |
| 8 | 16.643 | 6 | 42.4 | 4.210 |

TABLE 1-continued

| | Quantity of water [g] | polymer latex number | polymer latex concentration [%] | polymer latex weight [g] |
|---|---|---|---|---|
| 9 | 16.823 | 7 | 44.2 | 4.040 |
| 10 | 10.683 | 8 | 17.5 | 10.170 |

*pH adjusted to 5.5
#pH adjusted to 5
[a]= no buffer

The resulting emulsions were then doctor blade-coated to a wet thickness of 60 $\mu$m at a blade setting of 100 $\mu$m onto the 175 $\mu$m thick subbed polyethylene terephthalate support and dried for 10 minutes at 50° C., producing a silver behenate coverage of about 4.0 g/m$^2$.

Thermographic Printing

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors was 1.6 mJ/dot being sufficient to obtain maximum optical density in each of the thermographic materials of COMPARATIVE EXAMPLES 1 to 5 and INVENTION EXAMPLES 1 to 10.

Image Evaluation

The image tone of fresh prints made with the thermographic recording materials of COMPARATIVE EXAMPLES 1 to 5 and INVENTION EXAMPLES 1 to 10 were assessed on the basis of the L*, a* and b* CIELAB-values. The L*, a* and b* CIELAB-values were determined by spectrotometric measurements according to ASTM Norm E179-90 in a R(45/0) geometry with evaluation according to ASTM Norm E308-90. The L*, a*, and b* CIELAB-values of fresh prints of the thermographic recording materials of COMPARATIVE EXAMPLES 1 to 5 and INVENTION EXAMPLES 1 to 10 at an optical density, D, of 2.0 are summarized in table 2.

TABLE 2

| Comparative Example | CIELAB-values for fresh prints of thermographic materials for D = 2.0 | | | CIELAB-values for prints of thermographic materials after 3 days exposure on light box at 30° C. & 85% RH for D = 2.0 | | |
|---|---|---|---|---|---|---|
| Nr. | L* | a* | b* | L* | a* | b* |
| 1 | 11 | 1.5 | 7.0 | 9 | 1.5 | 7.0 |
| 2 | 10 | 2 | 6.0 | 10 | 2.0 | 5.0 |
| 3 | 10 | 2.5 | 6.5 | 9 | 2.5 | 6.0 |
| 4 | 11 | 2.0 | 8.0 | 9 | 1.5 | 7.0 |
| 5 | 10 | 2.0 | 6.5 | 10 | 1.5 | 7.0 |
| Invention Example Nr | | | | | | |
| 1 | 10 | 1.5 | 5.0 | 9 | 1.5 | 3.0 |
| 2 | 10 | 2.5 | 5.0 | 10 | 1.0 | 3.0 |
| 3 | 9 | 1.5 | 5.0 | 10 | 1.0 | 5.0 |
| 4 | 10 | 1.5 | 5.0 | 10 | 1.0 | 4.0 |
| 5 | 10 | 1.5 | 3.0 | 9 | 2.0 | 1.5 |
| 6 | 10 | 3.0 | 5.0 | 12 | 1.0 | 2.0 |
| 7 | 10 | 3.5 | 5.5 | 10 | 2.0 | 4.0 |

TABLE 2-continued

| Comparative Example | CIELAB-values for fresh prints of thermographic materials for D = 2.0 | | | CIELAB-values for prints of thermographic materials after 3 days exposure on light box at 30° C. & 85% RH for D = 2.0 | | |
|---|---|---|---|---|---|---|
| Nr. | L* | a* | b* | L* | a* | b* |
| 8 | 10 | 2.0 | 5.0 | 10 | 2.0 | 5.0 |
| 9 | 11 | 1.5 | 6.0 | 10 | 1.5 | 5.0 |
| 10 | 9 | 1.5 | 4.0 | 9 | 2.0 | 3.5 |

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive.

It is clear from the results in table 2 that fresh prints made with thermographic recording materials produced with latexes containing covalently bonded moieties with one or more acid groups or anhydrides thereof and prints exposed in a light box for 3 days at 30° C. in a relative humidity of 80% (INVENTION EXAMPLES 1 to 10) exhibit lower b*-values i.e. are less yellow and comparable a*-values compared with prints produced with thermographic recording materials produced with latexes not containing covalently bonded moieties with one or more acid groups or anhydrides thereof (COMPARATIVE EXAMPLES 1 to 5) i.e. the prints made with the thermographic materials of INVENTION EXAMPLE 1 to 10 using the reducing agents, according to the present invention exhibit, better colour neutrality before and after exposure in the light box than prints made with thermographic materials of COMPARATIVE EXAMPLES 1 to 5, according to the teaching of WO 94/16361.

The maximum densities, $D_{max}$, and minimum densities, $D_{min}$, of the prints given in table 3 were measured through visible or blue filters with a MACBETH™ TR924 densitometer in the grey scale step corresponding to data levels of 64 and 0 respectively and are given in table 3 for COMPARATIVE EXAMPLES 1 to 5 and INVENTION EXAMPLE 1 to 10.

Archivability Test

The achivability of prints made with the thermographic materials of COMPARATIVE EXAMPLES 1 to 5 and INVENTION EXAMPLES 1 to 10 was evaluated on the basis of the observed changes in minimum density, $D_{min}$, upon heating the prints at 35° C. in a relative humidity (RH) of 80% for 3 days in the dark. The results of these tests are given in tables 3 for COMPARATIVE EXAMPLES 1 to 5 and INVENTION EXAMPLES 1 to 10.

TABLE 3

| Comparative example number | AgBeh coverage [g/m$^2$] | FRESH PRINT $D_{max}$ vis/blue | FRESH PRINT $D_{min}$ vis/blue | Archivability $\Delta D_{min}$ vis/blue after 3d at 35° C./80% RH |
|---|---|---|---|---|
| 1 | 3.98 | 4.61/4.54 | 0.08/0.11 | 0.07/0.13 |
| 2 | 4.08 | 4.05/4.22 | 0.08/0.09 | 0.00/0.02 |
| 3 | 3.98 | 3.33/3.68 | 0.08/0.10 | 0.01/0.02 |

TABLE 3-continued

| Comparative example number | AgBeh coverage [g/m²] | FRESH PRINT $D_{max}$ vis/blue | FRESH PRINT $D_{min}$ vis/blue | Archivability $\Delta D_{min}$ vis/blue after 3d at 35° C./80% RH |
|---|---|---|---|---|
| 4 | 4.08 | 4.62/4.48 | 0.06/0.08 | 0.02/0.03 |
| 5 | 4.16 | 4.81/4.53 | 0.07/0.09 | 0.01/0.02 |
| Invention example number | | | | |
| 1 | 3.40 | 3.47/3.43 | 0.09/0.11 | 0.01/0.02 |
| 2 | 3.87 | 4.54/4.36 | 0.08/0.11 | 0.02/0.03 |
| 3 | 4.24 | 2.72/2.79 | 0.10/0.13 | 0.00/0.01 |
| 4 | 4.24 | 3.65/3.63 | 0.08/0.10 | 0.00/0.01 |
| 5 | 4.21 | 4.14/3.75 | 0.09/0.11 | 0.00/0.01 |
| 6 | 4.69 | 4.03/3.98 | 0.07/0.09 | 0.00/0.01 |
| 7 | 4.45 | 3.01/3.23 | 0.09/0.11 | 0.00/0.01 |
| 8 | 4.53 | 4.08/4.14 | 0.06/0.08 | 0.02/0.02 |
| 9 | 4.40 | 4.53/4.43 | 0.07/0.10 | 0.02/0.03 |
| 10 | 5.03 | 3.14/3.18 | 0.08/0.10 | 0.00/0.01 |

The results of the archivability tests show that the stability of prints made with the thermographic materials of INVENTION EXAMPLE 1 to 10 according to the present invention is comparable or superior to that of prints made with the best thermographic materials of the COMPARATIVE EXAMPLES (COMPARATIVE EXAMPLES 2,3 and 5) according to the teaching of WO 94/16361.

Having described in detail preferred embodiments of the current invention, it will now be apparent to those skilled in the art that numerous modifications can be made therein without departing from the scope of the invention as defined in the following claims.

What is claimed is:

1. A process for producing a substantially light-insensitive black and white thermographic material, comprising a support and a thermosensitive element which comprises a substantially light-insensitive organic silver salt, a reducing agent therefor in thermal working relationship therewith and a binder, wherein said binder is a water-dispersible film-forming polymer having monomer units containing one or more carboxylic acid or carboxylic anhydride groups, said process comprising:

(i) producing an aqueous dispersion of particles of the substantially light-insensitive silver salt;

(ii) modifying said dispersion of the silver salt into another aqueous dispersion comprising the silver salt, the reducing agent, and the binder; and (iii) coating the aqueous dispersion recited in step (ii) onto the support.

2. The process according to claim 1, wherein said binder is a water-dispersible film-forming polymer having monomer units selected from the group consisting of acrylic acid, methacrylic acid, crotonic acid, itaconic acid, mesaconic acid, glutaconic acid, citraconic acid, aconitic acid, maleic acid, maleic anhydride, fumaric acid, 3,4-dicarboxy-styrene and N-(1,2-dicarboxyethyl)-methacrylamide.

3. The process according to claim 1, wherein said binder is a water-dispersible film-forming polymer selected from the group consisting of crotonic acid, mesaconic acid, glutaconic acid, citraconic acid, aconitic acid, maleic acid, maleic anhydride, fumaric acid, 3,4-dicarboxy-styrene, and N-(1,2-dicarboxyethyl)-methacrylamide.

4. The process according to claim 1, wherein said binder is a water-dispersible film-forming polymer having methacrylic acid monomer units.

5. The process according to claim 1, wherein said binder is a water-dispersible film-forming polymer having acrylic acid monomer units.

6. The process according to claim 1, wherein said binder is a water-dispersible film-forming polymer having itaconic acid monomer units.

7. The process according to claim 1, wherein said polymer further comprises monomer units selected from the group consisting of acrylates, methacrylates, styrene, dienes, unsubstituted vinyl esters, substituted vinyl esters, polyols, polycarboxylic acids, and polyisocyanates.

8. The process according to claim 1, wherein said polymer is a polymer latex.

9. The process according to claim 1, wherein said thermosensitive element further comprises gelatin.

10. The process according to claim 1, wherein said thermosensitive element further comprises a protective layer.

* * * * *